US011766790B1

(12) United States Patent
Price

(10) Patent No.: US 11,766,790 B1
(45) Date of Patent: Sep. 26, 2023

(54) PIVOTING LOCKBAR IN A FOLDING KNIFE MECHANISM

(71) Applicant: Leroi Kramer Price, Saint Cloud, FL (US)

(72) Inventor: Leroi Kramer Price, Saint Cloud, FL (US)

(73) Assignee: LEROI KRAMER PRICE, Saintcloud, FL (US)

( * ) Notice: Subject to any disclaimer, the term of this patent is extended or adjusted under 35 U.S.C. 154(b) by 0 days.

(21) Appl. No.: 17/664,490

(22) Filed: May 23, 2022

(51) Int. Cl.
*B26B 1/04* (2006.01)

(52) U.S. Cl.
CPC ..... *B26B 1/04* (2013.01); *B26B 1/044* (2013.01)

(58) Field of Classification Search
None
See application file for complete search history.

(56) References Cited

U.S. PATENT DOCUMENTS 5,755,035 A * 5/1998 Weatherly ..... B26B 1/044 30/160
6,434,831 B2 * 8/2002 Chen ..... B26B 1/048 30/155
7,513,044 B2 * 4/2009 Lake ..... B26B 1/044 30/155
7,918,028 B2 * 4/2011 Steigerwalt ..... B26B 1/044 30/155
7,987,601 B2 * 8/2011 Nakamura ..... B26B 1/044 30/158
2006/0162168 A1 * 7/2006 Kao ..... B26B 1/048 30/161
2006/0260137 A1 * 11/2006 Flagg ..... B26B 1/044 30/160
2010/0325897 A1 * 12/2010 Chu ..... B26B 1/046 30/161
2011/0067247 A1 * 3/2011 Huang ..... B26B 1/048 30/161
2015/0367520 A1 * 12/2015 MacNair ..... B26B 1/044 30/161
2017/0106544 A1 * 4/2017 Hoppe ..... B26B 1/044

* cited by examiner

*Primary Examiner* — Hwei-Siu C Payer

(57) ABSTRACT

A locking mechanism for a tool or knife blade based on the locking liner lock. A hinge replaces the typical flex point at the base of the lockbar which allows the lockbar to be made of materials other than those required to be resilient. This allows materials that are lightweight, non metallic, and many other possibilities. As well very strong non resilient materials can be used which would avoid some of the mechanical failures that resilient materials have shown by bending due to downward force on the top of the tool or knife. This mechanical failure will not only destroy the ability of a knife to lock in the open position but the event will cause the blade to rotate toward the closed position and can cut the operators hand. That is a safety issue.

6 Claims, 4 Drawing Sheets

A Prior Art | B Prior Art | C Prior Art | D Prior Art | E | F | G

Fig. 11
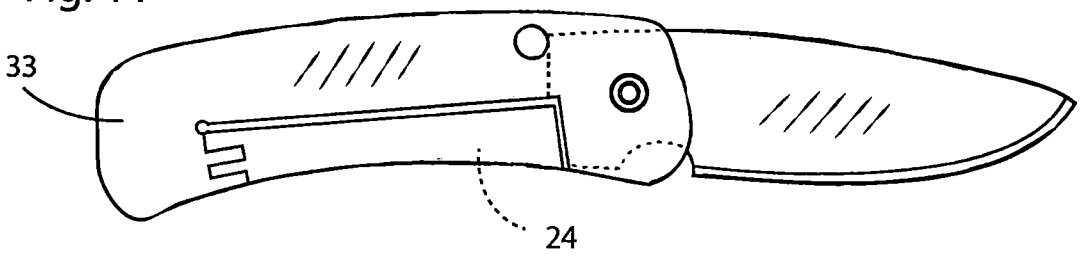
Fig. 12
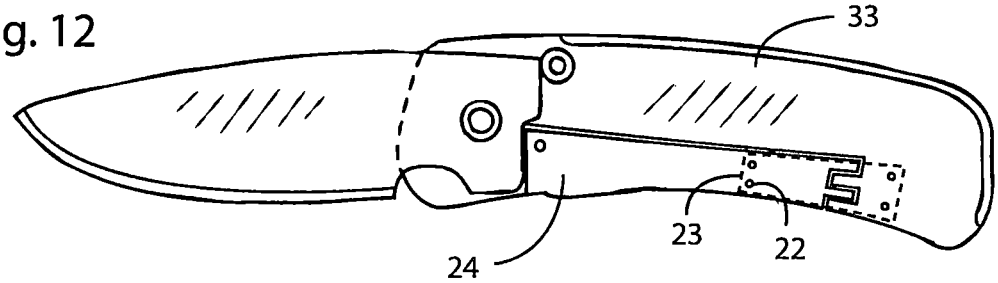
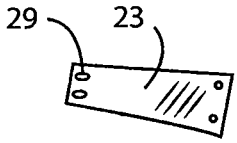
Fig. 13
Fig. 14
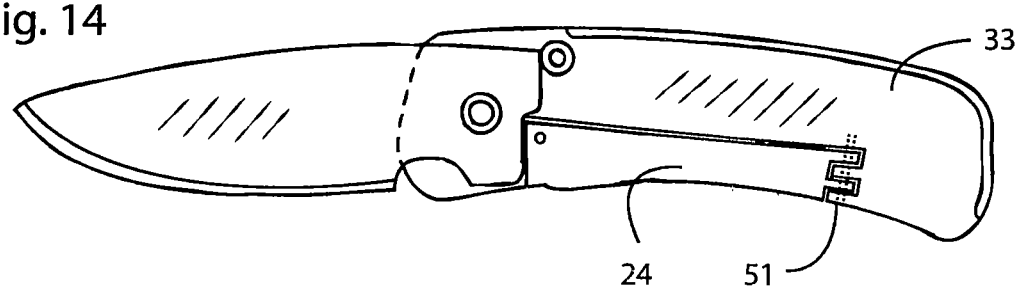
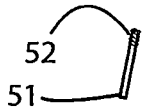
Fig. 15
Fig. 16 PRIOR ART
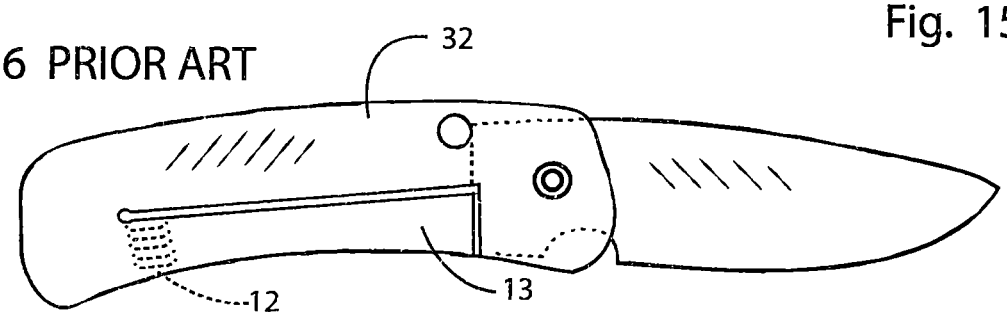

Fig. 17
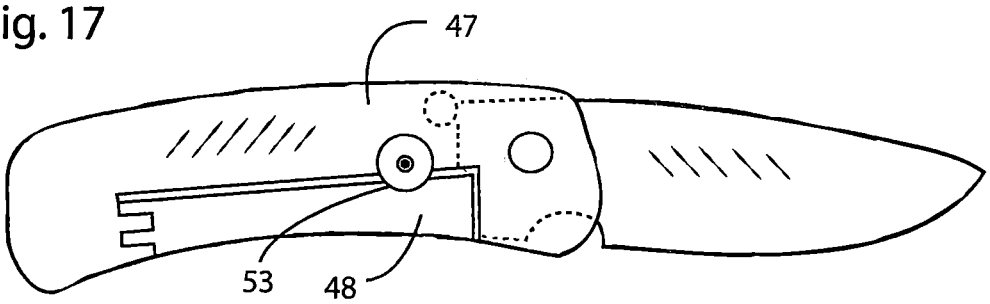
Fig. 18
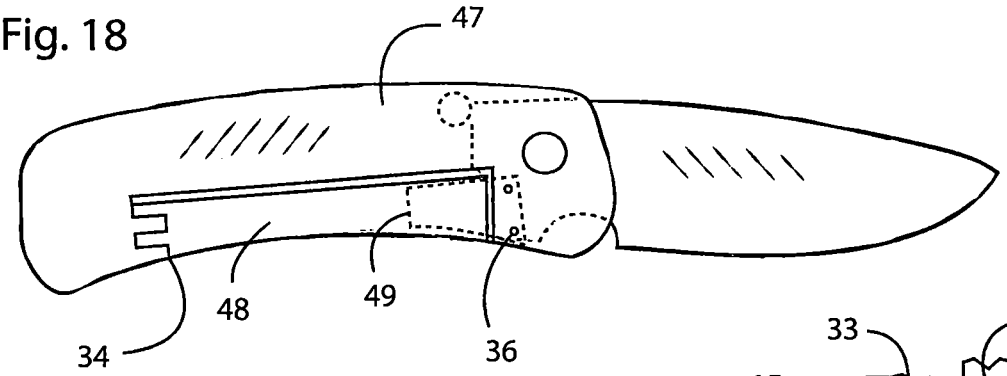
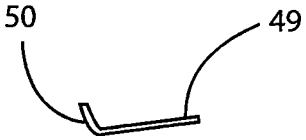
Fig. 19
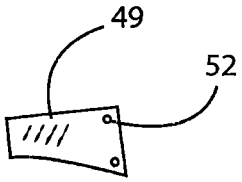
Fig. 20
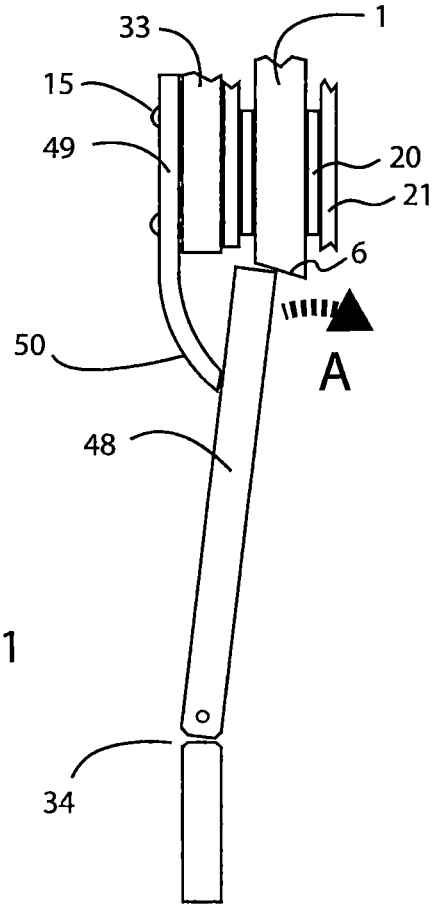
Fig. 21

PIVOTING LOCKBAR IN A FOLDING KNIFE MECHANISM

FIELD OF THE INVENTION

This invention pertains to a locking mechanism of a tool or folding knife, particularly the common locking liner mechanism that uses a side locking lockbar. This improved design strengthens the lockbar and also allows it to be constructed of a variety of different materials.

PRIOR ART

The lockbar, also called the spring or lockbar spring, in such side locking knives is made of resilient material. This is of benefit to the operation of the knife because it allows the lockbar to function as a spring as well as a locking latch on the blade. The spring thus formed is biased to move inward to the blade cavity which will automatically effect a lockup of the blade in the open position. This spring bias also has some benefit in the closed position for retaining of the blade within the blade cavity by use of a detent mechanism attached to the lockbar. The lockbar is often formed out of the liner of the folding knife although other methods are possible.

The required resilience of the lockbar material is also a detriment to the operation of the knife because the lockbar is made to flex and therefore problems can occur because it is not rigid. Downward force placed on the back of the blade will bias the blade to rotate toward the closed position. Since the lockbar is wedged behind the blade this force can cause the lockbar to bend inappropriately. The bending may be to a minor degree or to a catastrophic degree. Significant bending of the lockbar could result in the blade coming out of lockup causing the sharp edge of the blade to rotate against the fingers of the operator causing severe injury.

This problem is well known in the field. In an effort to build a folding knife with a stronger lockbar thicker material can be used. But the lockbar must still be resilient and function as a spring. Unfortunately the thicker the resilient material, the less flexibility of the lockbar, and thus the folding knife could be rendered nonfunctional due to such a great effort needed by the operator to manipulate the spring. There is a limit to the strength that can be achieved because of this absolute requirement of flexibility. The necessary use of strong flexible materials such as steel or titanium for lockbar construction also leads to this problem. Hence very thick handle material has been used for the formation of a strong safe lockbar which however makes the lockbar too stiff to unlock easily. Unfortunately in order for this thick resilient material to function as a lockbar spring, it must be adapted with a thin segment at the base of the lockbar. Otherwise the folding knife would be nonfunctional due to stiffness. Even resilient materials are stiff if they are thick. This thin segment remains a weak point for possible inappropriate bending and thus failure of the lockbar causing the blade to disengage from lock up. This thin segment is also a location of metal fatigue causing fracture of the spring. This type of lockbar design, termed "frame lock", might well be a bit stronger than one formed out of the uniformly thin liner but not stronger to a significant degree.

One size does not fit all. A strong lockbar needs a strong thumb to unlock the knife from its open position This may be uncomfortable to a person with small hands.

Resilient materials, or materials made to be resilient by forming them into thin parts are often mechanically weaker than non resilient materials.

Aesthetics of the folding knife can be impacted by the required choice of lockbar materials. A handle'of plastic or numerous other non metallic materials are unsuitable to be employed in the lockbar.

BRIEF DESCRIPTION OF CURRENT INVENTION

The necessity of flexibility in a side locking lockbar creates a danger that is solved by the current invention. By making the lockbar of rigid material that pivots by a hinge type joint rather than one that pivots by a bending type joint eliminates the necessity to use resilient material all together in the lockbar. A better solution is lockbar construction using thick or non resilient materials. Forces placed against the forward end of the lockbar can be transmitted directly to the rear end of the lockbar and into the knife handle through a hinge rather than through a thin bending segment of resilient material.

The lockup of the blade in the open position is the same as the standard liner locking knife which is the lock face of the lockbar wedging against the angled lock face of the blade tang. The need for resilient material is eliminated. The folding knife can be securely held in lockup merely by the grip of the operators hand. But for convenience a biasing spring can be added to bias the lockbar into lock up automatically in the open position. For example a separate spring placed in parallel to the lockbar can close the lockbar to lock up the knife which is akin to the function of the standard locking liner design. An extremely strong spring, difficult to manipulate, would not be required for this strong lockbar.

Springs eventually brake. A standard lockbar/spring failure can result in cut fingers as the unlocked blade pivots toward the closed position. It does happen. A well made, well designed knife may last hundreds of years. But all springs have one potential flaw. Metal fatigue. The repeated stretching and compressing stress can cause the molecular bonds of the spring to fracture. And often at the worst possible time. When a liner lock knife has a broken lockbar/spring it can no longer lock open. Fortunately it can still function as a friction folder knife. But it then becomes less effective as a useful tool. In a liner lock style knife using a mechanical hinge, the loss of a biasing spring, that has as its only function to conveniently pivot the lockbar into the lock-up position, is a loss of that convenience, but not loss of knife function. Numerous benefits of this current design are not only strength but the ability to use various materials of meta and non metal materials in accordance to weight, cost, manufacture such as injection molding, resistance to water, customer desire, and many others. Not to become inoperable due to a broken spring is a considerable benefit to the design.

This locking mechanism is suitable for a variety of tools, especially a knife blade, which will be the example used in the description.

DRAWINGS

FIG. 11 is the right profile of a locking liner knife that has the lockbar made of thick material and as such has no handle slab cover. The lockbar uses a pivot joint FIG. 12 is the left profile of the knife in FIG. 11. The left handle scale has been removed. The location of the leaf spring is shown.

FIG. 13 is a leaf spring.

FIG. 14 is essentially the knife of FIG. 12 used to show the location of the pivot pin.

FIG. 15 is the pivot pin.

FIG. 16 is the right profile of a prior art locking liner knife that uses thick material for the lockbar and no handle scale on the right side.

FIG. 17 is the right profile of a locking liner knife showing the device to stop excessive outward travel of the lockbar.

FIG. 18 is the right profile of a locking liner knife showing the location for an external spring.

FIG. 19 is the external spring top view

FIG. 20 is the external spring right side view

FIG. 21 is a bottom view looking up into the blade cavity showing the lockbar using a pivot joint and the lockbar in lockup by wedging into the blade tang. The external spring is shown.

DETAILED DESCRIPTION OF THE CURRENT INVENTION

This invention has a commonality to a hinge mechanism wherein two leaves are typically joined together by employing a plurality of interdigitating fingerlike projections termed the knuckles. These knuckles are often formed by rolling the ends of the finger like projections into a cylindrical form so as to form an elongated cavity in which will house a pivot pin. The diameter of said cavity is commensurate with the diameter of the pivot pin. The round pivot pin passes through these hinge knuckles which forms a connecting joint. This is a pivot joint which allows the two leaves of the hinge to pivot in a plane perpendicular to the pivot pin. As commonly used, one leaf is attached to a door while the other is attached to a door jam.

There are, however, other ways to create a hinge. Another method is merely to pass the pivot pin through the ends of the interdigitating projections to form a finger joint hinge. This method is usually less strong than that where the ends are rolled around a pivot pin but can be used to conserve space or circumvent other problems like being used in non ductile materials which can not be forged unlike the way most metals can be.

Figure 1:
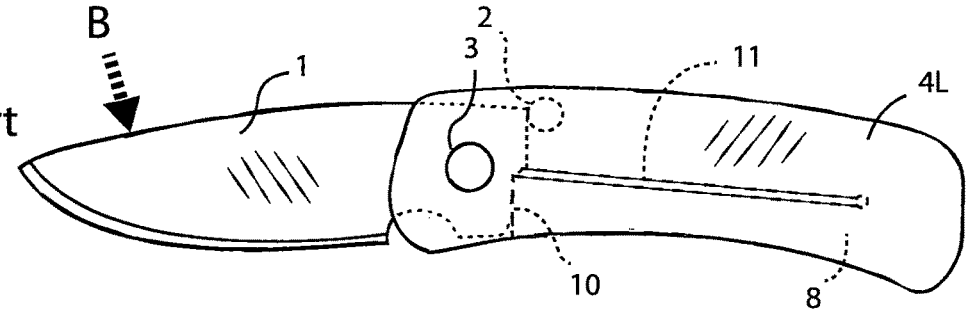
Fig. 1 Prior Art
FIG. 1 is a left side profile of prior art locking liner knife. Dotted lines depict covered parts.
Figure 2:
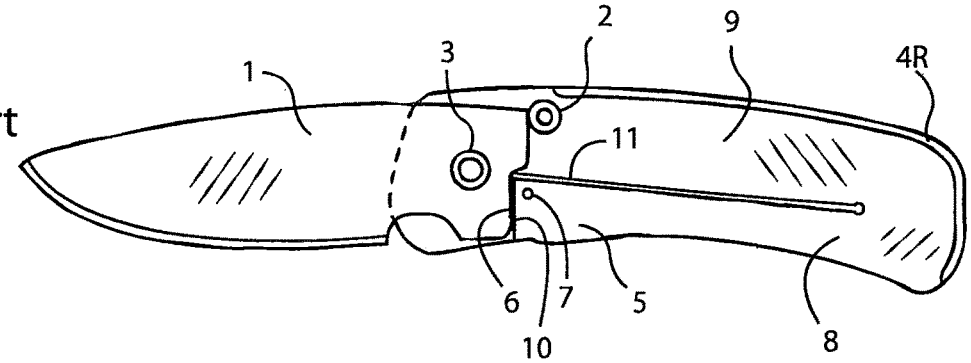
Fig. 2 Prior Art
FIG. 2 is a left side profile of a prior art locking liner knife with the left handle scale removed.
Figure 3:
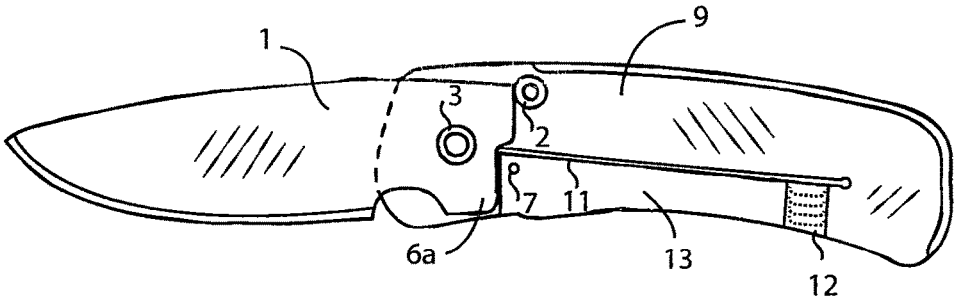
Fig. 3 Prior Art
FIG. 3 is a left side profile of a prior art locking liner knife that uses a very thick liner material with the left handle scale removed.

Referring to FIG. 1 through FIG. 3, this is a typical example of prior art. The standard liner lock, or also termed liner locking, mechanism having a blade 1, stop pin 2, blade pivot 3, and the handle scales, right 4R and left 4L, which form the handle sheath for the blade. The scales form an outer covering of the liners and blade. The right liner 9 is shown. At least one liner is needed from which a longitudinal slit 11 forms a leaf spring. This spring 5 may also be referred to as the lockbar. Major components of this leaf spring 5 include the lock face 10 on its front end and the ball detent 7, which assists keeping the blade within the handle while in the closed position, and the attachment area 8 of the spring 5 to the remainder of the right liner 9. It is at this area, the base of the spring, where the majority if not all bending of the spring 5 occurs.

The blade cavity is the space formed between the right and left handle scales. At the time of knife manufacture the spring 5 is bent inward into the blade cavity so that the set of the spring will permanently bias its lock face 10 inward to engage the lock face 6 of the blade tang 6*a*. In locking and unlocking the knife the front end of the spring 5 will be repeatedly moving in and out of the blade cavity. This bending will cause stress at its attachment area 8, the rearward base of the spring, which could lead to deformation or fracture of the spring.

The liner material is commonly made of titanium or steel and needs to be resilient and yet be able to take a set, or as has been referred to as "have a memory", in order to properly configure its shape. Overbending of the spring may cause it to take an unwanted permanent set also. If the stiffness of the spring material prevents easy bending by the operators thumb to unlock the knife then the thickness of the material used is reduced. But this can cause weakness at section 8, or of the entire spring 5, and result in excessive, deforming bending.

Figure 4:
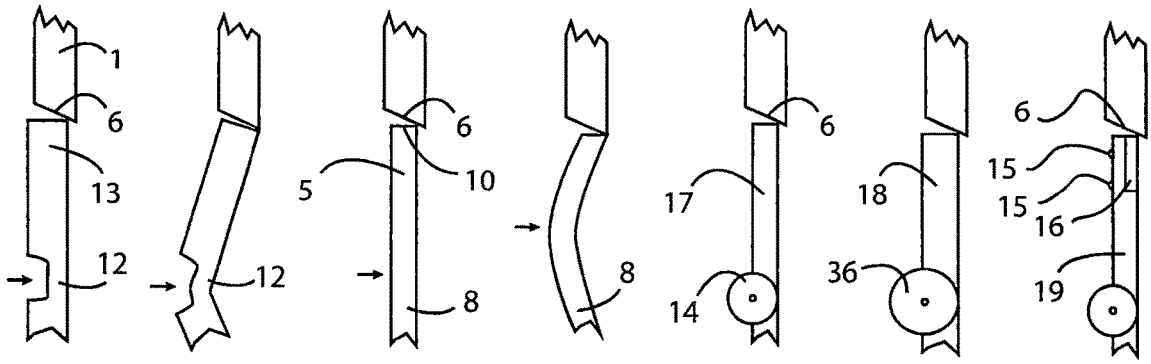
FIG. 4A is a bottom view of prior art looking up into the blade cavity showing the lockbar made of thick material and blade tang with the blade in the open and locked position.
FIG. 4B is a bottom view of prior art looking up into the blade cavity showing the bent lockbar made of thick material and blade tang after extreme stress has been placed on the blade.
FIG. 4C is a bottom view of prior art looking up into the blade cavity showing the lockbar made of regular thickness material and blade tang with the blade in the open and locked position.
FIG. 4D is a bottom view of prior art looking up into the blade cavity showing the bent lockbar made of regular thickness material and blade tang after extreme stress has been placed on the blade.
FIG. 4E is a bottom view looking up into blade cavity showing the lockbar made of regular thickness material using a pivot joint and blade tang.
FIG. 4F is a bottom view looking up into the blade cavity showing the lockbar made of thick material using a pivot joint blade tang.
FIG. 4G is a bottom view looking up into the blade cavity showing the lockbar made of thick material using a pivot joint also with a hard material insert blade tang.

The diagrams of a locking spring, seen from the bottom of a liner lock knife, are depicted in FIGS. 4A through 4G. In FIG. 4C, a view of the spring and tang from the bottom of the knife, is showing the typical prior art liner lock in open position lockup with engagement between the blade tang lock face 6 and the spring lock face 10 at the forward end of the spring 5. The mechanics of this lockup are based on wedging of the forward tip of the spring 5 into the ramp face 6 as is well known to people of the art. The ARROW in FIG. 4C shows the general area where the spring would bend during normal function. This flexing point of the spring would generally correspond to its portion at or just forward of area 8 seen in FIG. 2.

A situation where extreme downward force on the back of the blade, depicted by DOTTED ARROW B in FIG. 1, biasing the blade to rotate down from the open position toward the closed position, would cause the spring to fail by bending, thus transitioning from FIG. 4C, to the typical result which would look like FIG. 4D. The center point or bow of the bend in the spring, ARROW in 4D, would occur about half way between the forward tip of the spring, at lockface 10 and the attachment area 8. The thinner the spring 5 or the more flexible the resilient material it is made of, the more easily the operator can unlock the knife, however, the more likely an extreme force against the back of the blade will cause a failure of the spring by bending as depicted in FIG. 4D.

Another approach to liner lock knife construction is the use of very thick resilient material for the spring as shown in 13, FIG. 4A. This method is the concept of the "frame lock" in which thick material is used also obviates the need of separate covering handle scales. However, this is not a useful method to avoid spring failure from bending because the thick spring is difficult for the operator to manipulate. To circumvent the problem of stiffness in a thick spring 13 a thin, more flexible, segment 12 is formed at the attachment area which is similar in function to that of area 8 of a thinner spring. This is the sole area of bending of this spring. The bottom view of the spring 13 in FIG. 4A reveals how the thick spring/lockbar 13 is much thicker than spring 5 except that the thin segment 12 presents an obvious weak point. FIG. 4B shows the result of extreme downward force on the back of the blade. The spring 13 has failed as did spring 5 but the ARROW depicts the location where the bend occurred. This construction method of spring 13 is likely stronger than that of spring 5 yet still flawed due to the necessity of the thin segment 12 for flexibility.

The current invention is a method of lockbar construction in which there is no necessity of using flexible or thin materials. The basic geometry is shown in FIG. 4E. The lockbar 17 in this preferred embodiment functions in the same fashion to the standard lockbar mechanism in that the lockbar 17 is made of steel, titanium, or other tough material which can grip the bevel edge of the knife tang 6 creating a wedge lockup. The lockbar is able to pivot in and out of lockup due to pivot joint 14. Pivot joint 14 is constructed with enlarged knuckles, which provides strength, around the cavity holding pivot pin 38.

If weaker or flexible materials are to be used in lockbar construction a thicker lockbar 18 as seen in FIG. 4F can be employed. Also for additional strength in the locking mechanism the further enlargement of the pivot knuckles 36 can also be employed.

The construction of a lockbar of non tough, friable, materials is prohibited not only because of non resilience but also the need of an abrasion proof quality needed for wedging lockup at the tang face 6 to the lockbar face 10. A mechanical gripping needs to occur and soft or brittle materials would break and malfunction.

Figure 9:
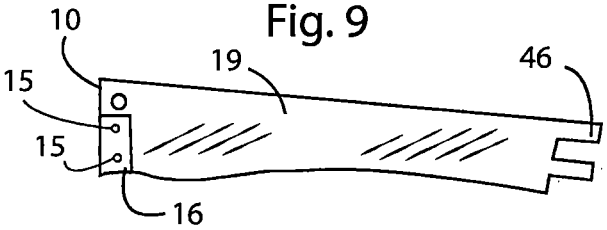
FIG. 9 is the left side of a lockbar having a finger joint pivot and a hard material insert.

A hard material insert at the lock face of the lockbar solves this abrasion problem. This hard material could be a variety of materials such as carbon steel, ceramic, or tungsten carbide. This technique can be employed in the current invention to an advantage whereupon stiff but soft or friable materials could be used to construct a lockbar such as carbon fiber, aluminum, or natural materials. The technique is shown in FIG. 4G and FIG. 9. Insert 16 is located at the forward end of the lockbar so that its forward edge makes contact with the lock face 6 of the blade tang 6*a*. The insert is attached to the lockbar by standard mechanical means such as screws 15. The lockbar 19 has the freedom of being made of most any stiff material to the advantage of properties such as weight, appearance, corrosion resistance, and more.

The lockbar in a liner lock knife comes in contact with the operators hand when being used. A firm hand grip on the knife is common. This usually produces an inward bias against the lock bar which keeps the knife in lockup or termed the locked open position. Even if the position of the knife is rearranged in the hand during a cutting procedure once the end of the lockbar has been initially wedged into the tang lock face, the knife will likely stay in lockup without the lockbar needing constant inward bias. In a standard liner locking knife there is inward bias on the lockbar provided by the resilience of the lockbar/spring itself. But this bias force is comparatively weak to the forces encountered on the back of the blade as a result of active use of the knife. This force tends to rotate the blade down, toward the closed position, as depicted by ARROW B in FIG. 1.

Although a spring is not necessary to effect a firm lockup of a locking liner mechanism it is nevertheless a key element of convenience. The operator does not have to remember to squeeze the knife handle to wedge in the lockbar after opening the knife to insure lockup has occurred since the bias provided by the spring/lockbar moves the lockbar inward to wedge against the tang lockface and thus effects the lockup. Furthermore, in the closed position the inward bias is useful to detent the blade from rotating toward open as is commonly known to those skilled in the art.

Figure 5:
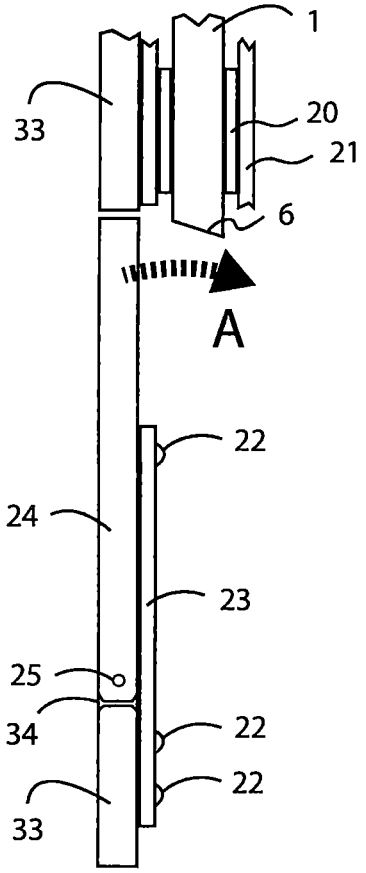
FIG. 5 is a bottom view looking up into the blade cavity showing the lockbar made of regular thickness material using a pivot joint and a closure spring and blade tang.
Figure 6:
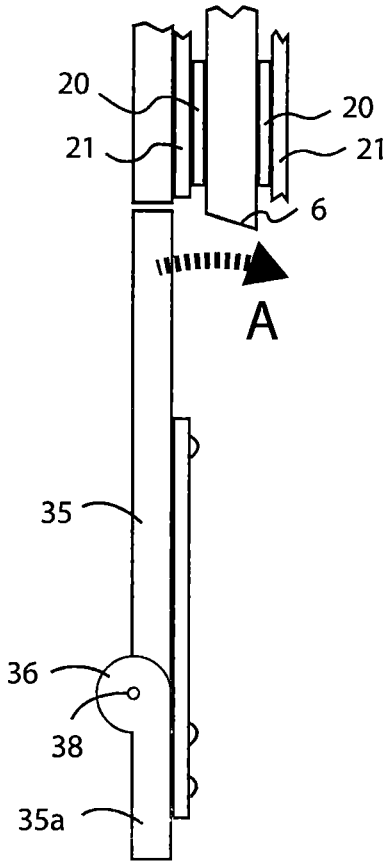
FIG. 6 is a bottom view looking up into the blade cavity showing the lockbar made of regular thickness material using a pivot joint with knuckles and a closure spring and blade tang.
Figure 7:
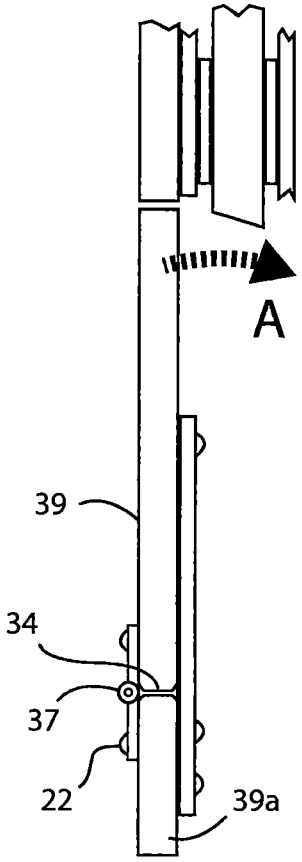
FIG. 7 is a bottom view looking up into the blade cavity showing the lockbar made of regular thickness material using a modular pivot joint and a closure spring and blade tang.

A biasing spring can be added to the pivoting lockbar as depicted in FIG. 5-7. A leaf spring 23 made of resilient material is positioned across the joint 34 of the lockbar 24 and the rear of the right handle scale 33. The leaf spring can be attached by several means including mechanical fasteners such as screws or rivets 22. The leaf spring will have been bent, or set, at the time of manufacture to provide inward bias. The lockbar pivoting caused by this bias is inward, moving the lockbar into the blade cavity, and is depicted by DOTTED ARROW A seen in FIGS. 5-7.

In FIGS. 5-7 the bottom view of the pivot mechanism is shown. The left handle scale is not shown. The blade 1 is typically sandwiched between right and left washers 20, right and left liners 21, and right and left handle scales. Liners would typically not be needed in the preferred embodiment since construction of the knife follows a frame lock knife pattern. FIG. 5 shows an embodiment of the invention that forms a pivot joint without additional material forming knuckles. Even though the knuckles do not extensively protrude outward this design forms a pivot joint that has no protrusion. The strength of this pivot joint however is lessened by its thinness. The leaf spring 23 biases the lockbar to pivot inward as depicted by ARROW A. A pivot pin 25 connects the lockbar 24 to the handle 33.

FIG. 6 is the preferred embodiment using enlargement of material at the joint to form knuckles 36. The rear end of lockbar 35 and the edge of the remainder part of the handle material of handle 35A are modified to create this joint. The pivot pin 38 makes the connection.

FIG. 7 shows a variation using rather than integral knuckles a modular hinge unit 37 which is attached to the rear end of lockbar 39 and the handle slab 39*a*. The modular hinge unit is of standard hinge construction being placed across the joint 34 which will allow the lockbar to pivot inward. The modular hinge unit is mechanically attached by standard means such as screws, rivets 22, or adhesion methods.

Figure 8:
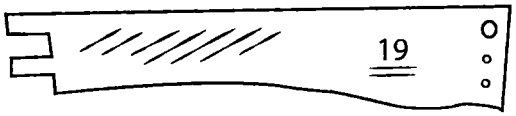
FIG. 8 is the right side of a lockbar having a finger joint pivot.

FIG. 8 is a view of the right side of a lockbar 19. FIG. 9 is the left side of lockbar 19 which shows the position of the metal insert 16. At the rear is a finger projection 46 which is part of the interdigitating fingers comprising a pivot joint. Commensurate to that formation are the spaces 45, as depicted in FIG. 10, which receive the finger projections to form the pivot joint.

Figure 10:
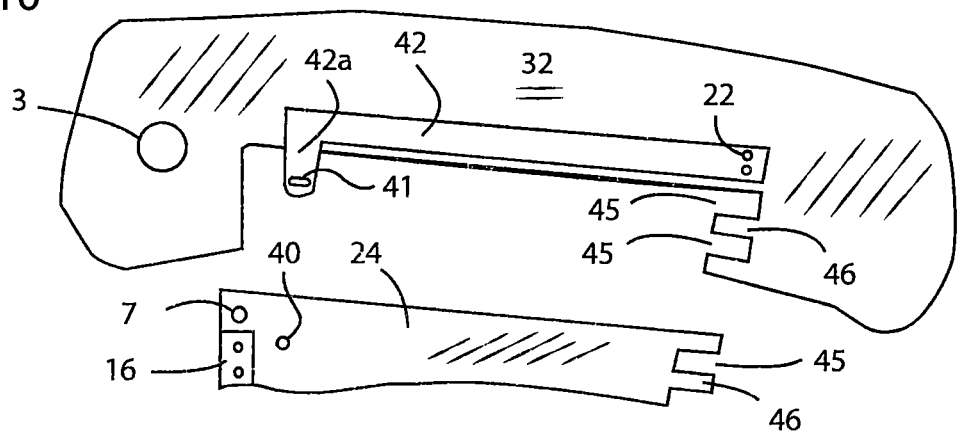
FIG. 10 is the left side of a knife with the left handle scale removed having a closure spring and shown also is the left side of a lockbar, detached, having a finger joint pivot and a hard material insert.

In FIG. 10 the lockbar 24 is drawn detached from the knife for clarity to show the finger joints. Also seen is spring 42 which is attached to the left side of handle 32. This leaf spring resides within the blade cavity and the spring is not situated over the hinge joint of the lockbar to the handle 32, whereas spring 23 as seen in FIG. 5 does overlap this similar joint 34.

From spring 42 a protrusion 42*a* is mechanically attached to lockbar 24 using its aperture 41 which is an elongated slot through which it receives screw 40. The elongated slot allows the attachment screw 40 to travel front to back as necessary to compensate for the difference in radii between the lockbar and spring during their pivoting in and out of the blade cavity. Similar elongation of apertures for rivets 22 of spring 23 seen in FIG. 5 may also be necessary to prevent binding during pivoting of that lockbar. However, there are numerous other ways to mechanically attach the spring to the lockbar. Leaf spring 42 can be thin and may reside alongside of the blade within the blade cavity sitting proud of the handle 32 but also may also reside deeper in the handle 32 in a routed out area. Spring 42 is constructed of resilient material and will bias the lockbar inward toward lockup of the knife in the open position but a detent 7 may also be placed on lockbar 24 similar to that used in prior art to assist the blade or tool to remain in the closed position.

FIG. 11 is the right side profile of the knife of the current invention assembled showing the variation as to the right profile of the knife in FIG. 16 that uses a thick lockbar but with a thin segment 12 at the attachment area of the lockbar. This is similarly depicted in FIG. 4*a*.

FIG. 12 shows how a spring 23 is located in the assembled knife by the dotted lines. The dotted outline depicts its placement across the hinge joint 34 so as to bias the lockbar. Spring 23 has the same purpose as spring 42. FIG. 13 shows the leaf spring 23 and several front and rear attachment holes for mechanical fasteners. The forward set of holes 29 are elongated so that the rivets 22 or other fasteners will not bind as the spring bends.

FIG. 14 has a dotted outline which shows the location of the pivot pin 51 within the knuckles of the joint. The pivot pin 51 seen in FIG. 15 has a threaded end 52 which corresponds to internal threads of the blind hole in handle 33 that receives the pivot pin. This threading is one of several methods which can be used to retain the pivot pin within the knife.

If it desired to not use a spring for closure bias on the lockbar it would be advantageous to add a stop device to prevent the outward rotation of the lockbar beyond the outside edge of the handle. This is not an issue if the lockbar has inward bias from a spring such as spring 23. Nevertheless a stop device could be added. Such devices are known to those skilled in the art. One example is shown in FIG. 17. Disk 53 is mechanically attached to handle 47 and stops the excessive outward pivoting of lockbar 48. Disk 53 would typically be sitting within a routed out recess in the handle and lockbar so as to not sit proud of them.

FIG. 18 is an alternate embodiment wherein a biasing leaf spring 49 is used to push in the lockbar rather than pull in toward the blade cavity. This spring can be located over the pivot joint 34 but in this example it is located over the gap between the lockbar 48 and the handle 47. The dotted line depicts the spring 49 placement onto the outside of the knife. Holes 36 serve in conjunction with mechanical fasteners, such as screws, used to attach the leaf spring to the knife. Other mechanical attachment methods, such as entrapment of a spring edge under a bolster or making the spring integral to the bolster, are possible. The form of spring 49 must follow function which requires a protrusion either on the lockbar or on the rear end of the spring.

FIG. 19 bottom view shows a bent end 50 which serves as a protrusion the purpose of making contact with the lockbar as its inward pivoting causes it to move out of the plane of the main flat surface of spring 49. The result is seen in FIG. 21. This figure is of the knife in the open and locked position, whereas FIGS. 5-7 are when the knives are in the open position with the lockbars having not yet pivoted into lockup. The DOTTED ARROW A in FIG. 21 shows the bias force exerted on the lockbar. The spring 49 is held by mechanical fasteners, in this example rivets 15 are used. The bent end 50 makes contact with the lockbar throughout its pivoting into the blade cavity to a point where it wedges into lock face 6. FIG. 20 shows hole 52 cut into spring 49 congruous with a mechanical means of attachment to the knife.

A right and left handle scale is recommended, however, a knife can be manufactured using only one scale which would have the appearance as FIG. 12 with the same plan of construction just that there would be no placement of the left scale on the knife of FIG. 12.

What is claimed:

1. A folding knife comprising:

a handle formed of right and left handle scales to form a sheath cavity for a blade;

the handle having a front end and a rear end;

the blade having a front end and a rear end with its rear end rotatably connected to the front end of the handle by a pivot pin;

the blade rotates in a path into and out of the sheath cavity;

the blade having a closed position within the sheath cavity and an open position outside the sheath cavity;

a lockbar having a front end and a rear end of which its rear end is pivotally attached to the rear end of the handle;

the lockbar is mechanically attached to the handle by a hinge mechanism;

the hinge mechanism being formed integrally out of interdigitating projections;

the interdigitating projections being formed out of at least one fingerlike projection from the rear end of the lockbar and at least one fingerlike projection from the rear end of one of the handle scales;

the hinge mechanism has a pivot pin there through;

the hinge mechanism allowing the front end of the lockbar to pivot inward into the sheath cavity;

the lockbar having a pivoting path that is perpendicular to the path of the blade rotation;

the rear end of the blade having a tang with a lock face;

the front end of the lockbar having a lockface that wedges against the lock face on the rear end of the blade tang;

wedging of the lockbar lockface against the tang lock face reversibly locks the blade in the open position outside the sheath cavity.

2. The folding knife of claim 1, wherein the lockbar is made of material chosen from a group comprising:

metal and non metallic material.

3. The folding knife of claim 1, comprising:

leaf spring mechanically attached to the handle.

4. The folding knife of claim 1, comprising:

leaf spring mechanically attached to the lockbar.

5. A folding knife comprising:

a hinge unit that is modular;

a handle formed of right and left handle scales to form a sheath cavity for a blade;

the handle having a front end and a rear end;

the blade having a front end and a rear end with its rear end rotatably connected to the front end of the handle by a pivot pin;

the blade rotates in a path into and out of the sheath cavity;

the blade having a closed position within the sheath cavity and an open position outside the sheath cavity;

a lockbar having a front end and a rear end of which its rear end is pivotally attached to the rear end of the handle;

the hinge unit being a separate module formed out of interdigitating projections forming a knuckle with a pivot pin there through;

the hinge unit having a front end and a rear end;

the hinge unit front end is mechanically attached to the rear end of the lockbar;

the hinge unit rear end is mechanically attached to the rear end of the handle;

the hinge unit allows the front end of the lockbar to pivot inward into the sheath cavity;

the lockbar having a pivoting path perpendicular to the path of the blade rotation;

the rear end of the blade having a tang with a lock face;

the front end of the lockbar having a lockface that wedges against the lock face on the rear end of the blade tang;

wedging of the lockbar lockface and the tang lock face reversibly locks the blade in the open position outside the sheath cavity.

6. The folding knife of claim 5, wherein the lockbar is made of material chosen from a group comprising metal and non-metallic material.

* * * * *